US010109406B2

(12) United States Patent
Takashita et al.

(10) Patent No.: US 10,109,406 B2
(45) Date of Patent: Oct. 23, 2018

(54) IRON POWDER FOR DUST CORE AND INSULATION-COATED IRON POWDER FOR DUST CORE

(71) Applicant: JFE STEEL CORPORATION, Chiyoda-ku, Tokyo (JP)

(72) Inventors: Takuya Takashita, Chiba (JP); Naomichi Nakamura, Chiba (JP)

(73) Assignee: JFE STEEL CORPORATION, Chiyoda-ku, Tokyo (JP)

( * ) Notice: Subject to any disclaimer, the term of this patent is extended or adjusted under 35 U.S.C. 154(b) by 224 days.

(21) Appl. No.: 14/764,665

(22) PCT Filed: Apr. 8, 2014

(86) PCT No.: PCT/JP2014/002008
§ 371 (c)(1),
(2) Date: Jul. 30, 2015

(87) PCT Pub. No.: WO2014/171105
PCT Pub. Date: Oct. 23, 2014

(65) Prior Publication Data

US 2015/0371746 A1 Dec. 24, 2015

(30) Foreign Application Priority Data

Apr. 19, 2013 (JP) ..... 2013-088717

(51) Int. Cl.

| | |
|---|---|
| ***H01F 1/26*** | (2006.01) |
| ***C22C 38/00*** | (2006.01) |
| ***C22C 33/02*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| *H01F 3/08* | (2006.01) |
| *H01F 41/02* | (2006.01) |

(52) U.S. Cl.
CPC ..... *H01F 1/26* (2013.01); *C22C 33/02* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *H01F 3/08* (2013.01); *H01F 41/0246* (2013.01)

(58) Field of Classification Search
CPC ..... C22C 38/42; C22C 38/06; C22C 38/04
USPC ..... 148/105
See application file for complete search history.

(56) References Cited

U.S. PATENT DOCUMENTS

| | | | |
|---|---|---|---|
| 7,235,208 | B2 | 6/2007 | Moro |
| 7,455,905 | B2 | 11/2008 | Ye et al. |
| 2003/0077448 | A1 | 4/2003 | Ueta et al. |
| 2003/0150523 | A1 | 8/2003 | Fujiwara et al. |
| 2006/0214138 | A1 | 9/2006 | Ye |
| 2007/0169851 | A1 | 7/2007 | Kugai et al. |
| 2010/0080725 | A1* | 4/2010 | Fujitsuka et al. ..... 419/11 |
| 2012/0048063 | A1 | 3/2012 | Maetani et al. |
| 2012/0164453 | A1 | 6/2012 | Hojo et al. |
| 2013/0057371 | A1 | 3/2013 | Shimoyama et al. |
| 2013/0244159 | A1 | 9/2013 | Ishigami et al. |
| 2014/0048184 | A1 | 2/2014 | Sakaguchi et al. |

FOREIGN PATENT DOCUMENTS

| | | | |
|---|---|---|---|
| CN | 1615528 | A | 5/2005 |
| CN | 101534979 | A | 9/2009 |
| CN | 102543346 | A | 7/2012 |
| CN | 102689008 | A | 9/2012 |
| JP | H01-40881 | B2 | 9/1989 |
| JP | H08269501 | A | 10/1996 |
| JP | 2002083709 | A | 3/2002 |
| JP | 2002329626 | A | 11/2002 |
| JP | 2003142310 | A | 5/2003 |
| JP | 2003303711 | A | 10/2003 |
| JP | 2005-213621 | A | 8/2005 |
| JP | 2006-233295 | A | 9/2006 |
| JP | 2010047788 | A | 3/2010 |
| JP | 2010-209469 | A | 9/2010 |
| JP | 2011202213 | A | 10/2011 |
| JP | 4880462 | B2 | 2/2012 |
| JP | 2012-140679 | A | 7/2012 |
| JP | 2012133347 | A | 7/2012 |
| JP | 2012-211383 | A | 11/2012 |
| JP | 2013-149661 | A | 8/2013 |
| JP | 2013187480 | A | 9/2013 |
| WO | 2008093430 | A1 | 8/2008 |
| WO | 2011126120 | A1 | 10/2011 |

OTHER PUBLICATIONS

May 4, 2016, Office Action issued by the State Intellectual Property Office in the corresponding Chinese Patent Application No. 201480021748.8 with English language Search Report.
Dec. 6, 2016, Office Action issued by the Korean Intellectual Property Office in the corresponding Korean Patent Application No. 10-2015-7025651 with English language concise statement of relevance.
Nov. 16, 2016, Office Action issued by the Canadian Intellectual Property Office in the corresponding Canadian Patent Application No. 2,903,399.
May 27, 2014 International Search Report issued in International Patent Application No. PCT/JP2014/002008.
Aug. 4, 2015, Office Action issued by the Japan Patent Office in the corresponding Japanese Patent Application No. 2014-532170.
(Continued)

*Primary Examiner* — Edward M Johnson
(74) *Attorney, Agent, or Firm* — Kenja IP Law PC

(57) ABSTRACT

Iron powder for dust cores that is appropriate for manufacturing a dust core with low iron loss is obtained by setting the oxygen content in the powder to be 0.05 mass % or more to 0.20 mass % or less, and in a cross-section of the powder, setting the area ratio of inclusions to the matrix phase to be 0.4% or less.

4 Claims, No Drawings

(56) References Cited

OTHER PUBLICATIONS

Oct. 17, 2017, Office Action issued by the Korean Intellectual Property Office in the corresponding Korean Patent Application No. 10-2017-7022533 with English language Concise Statement of Relevance.
Dow Coming Toray Co.,Ltd., Catalog, "Silicon for Paints and Coatings", May 2006, with a partial English translation.
May 8, 2018, Ruling on the Patent Opposition issued by the Japan Patent Office in the corresponding Japanese Patent No. 6056862 with English language Concise Statement of Relevance.
Shin-Etsu Chemical Co., Ltd., Catalog, "Silicon Resin", Aug. 2006, with a partial English translation.
Tokuhiko Nishida et al., Magnetic Properties of Atomized Iron Powder Compacts for Magnetic Cores, Journal of the Japan Institute of Metals and Materials, 1978, pp. 593-599, vol. 42, Issue 6.

* cited by examiner

IRON POWDER FOR DUST CORE AND INSULATION-COATED IRON POWDER FOR DUST CORE

TECHNICAL FIELD

This disclosure relates to iron powder for dust cores and insulation-coated iron powder for dust cores that yield dust cores with excellent magnetic properties.

BACKGROUND

Magnetic cores used in motors, transformers, and the like are required to have high magnetic flux density and low iron loss. Conventionally, electrical steel sheets have been stacked in such magnetic cores, yet in recent years, dust cores have attracted attention as magnetic core material for motors.

The most notable characteristic of a dust core is that a 3D magnetic circuit can be formed. Since electrical steel sheets are stacked to form a magnetic core, the degree of freedom for the shape is limited. A dust core, on the other hand, is formed by pressing soft magnetic particles coated with insulation coating. Therefore, all that is needed is a die in order to obtain a greater degree of freedom for the shape than with electrical steel sheets.

Press forming is also a shorter process than stacking steel sheets and is less expensive. Combined with the low cost of the base powder, dust cores achieve excellent cost performance. Furthermore, since the surfaces of the electrical steel sheets are insulated, the magnetic properties of the electrical steel sheet in the direction parallel to the steel sheet surface and the direction perpendicular to the surface differ, causing the magnetic cores consisting of stacked electrical steel sheets to have the defect of poor magnetic properties in the direction perpendicular to the surface. By contrast, in a dust core, each particle is coated with insulation coating, yielding uniform magnetic properties in every direction. A dust core is therefore appropriate for use in a 3D magnetic circuit.

Dust cores are thus indispensable material for designing 3D magnetic circuits, and due to their excellent cost performance, they have also been used in recent years from the perspectives of reducing the size of motors, reducing use of rare earth elements, reducing costs, and the like. Research and development of motors with 3D magnetic circuits has thus flourished.

When manufacturing high-performance magnetic components using such powder metallurgy techniques, there is a demand for components to have excellent iron loss properties after formation (low hysteresis loss and low eddy current loss). These iron loss properties, however, are affected by the strain remaining in the magnetic core material, impurities, grain size, and the like. In particular, among impurities, oxygen is an element that greatly affects iron loss. Since iron powder has a greater oxygen content than steel sheets, it is known that the oxygen content should be reduced insofar as possible.

Against this background, JP 2010-209469 A (PTL 1), JP 4880462 B2 (PTL 2), and JP 2005-213621 A (PTL 3) disclose techniques for reducing the iron loss of magnetic core material after formation by reducing the oxygen content in iron powder to less than 0.05 wt %.

CITATION LIST

Patent Literature

PTL 1: JP 2010-209469 A
PTL 2: JP 4880462 B2
PTL 3: JP 2005-213621 A

Even if the oxygen in iron powder is reduced as disclosed in PTL 1, PTL 2, and PTL 3, however, the extent of reduction in iron loss is insufficient for use as a magnetic core for a motor.

It could therefore be helpful to provide iron powder for dust cores and insulation-coated iron powder for dust cores in order to manufacture a dust core with low iron loss.

SUMMARY

Upon carefully examining iron loss reduction in dust cores, we discovered the following facts.

(I) The reason why iron loss increases due to an increase in the oxygen content is because oxygen is present in the particles in the form of inclusions. If inclusions in the particles are sufficiently reduced, a dust core with low iron loss can be obtained, even if a large amount of oxygen is included.

(II) If inclusions in the iron powder are sufficiently reduced, iron powder that contains a certain amount of oxygen actually has lower iron loss than iron powder with a low oxygen content.

Our iron powders are based on these discoveries.

We thus provide:

1. Iron powder for dust cores comprising iron powder obtained by an atomizing method containing iron as a principal component, wherein an oxygen content in the powder is 0.05 mass % or more and 0.20 mass % or less, and in a cross-section of the powder, an area ratio of an inclusion to a matrix phase is 0.4% or less.

2. Insulation-coated iron powder for dust cores comprising: the iron powder for dust cores of 1., and an insulation coating applied thereto.

3. The insulation-coated iron powder for dust cores of 2., wherein a rate of addition of the insulation coating with respect to the iron powder for dust cores is at least 0.1 mass % or more.

4. The insulation-coated iron powder for dust cores of 2. or 3., wherein the insulation coating is silicone resin.

By adjusting the inclusions in the iron powder particles and the oxygen content of the iron powder, iron powder for dust cores and insulation-coated iron powder for dust cores in order to manufacture a dust core with low iron loss can be obtained.

DETAILED DESCRIPTION

Our iron powders will now be described in detail. Iron is used as the principal component in our powders. Such powder with iron as the principal component refers to including 50 mass % or more of iron in the powder. Other components may be included as per the chemical composition and ratios used in conventional iron powder for dust cores.

Iron loss is roughly classified into two types: hysteresis loss and eddy current loss.

Hysteresis loss is loss that occurs due to the presence of a factor that blocks magnetization in the magnetic core at the time the magnetic core is magnetized. Magnetization occurs due to displacement of the domain wall within the microstructure of the magnetic core. At this time, if a fine non-magnetic particle is present within the microstructure, the domain wall becomes trapped by the non-magnetic particle, and extra energy becomes necessary to break away from the non-magnetic particle. As a result, hysteresis loss increases. For example, since oxide particles are basically non-magnetic, they act as a factor in the increase of hysteresis loss for the above-described reason.

Furthermore, if inclusions such as oxide particles are present in the powder, they become pinning sites at the time of recrystallization. Hence, not only are inclusions not preferable for suppressing grain growth, but also the inclusions themselves become nuclei-generating sites of recrystallized grains, refining the crystal grain after formation and strain relief annealing. As described above, inclusions themselves also cause an increase in hysteresis loss.

Upon carefully examining the relationship between inclusions and hysteresis loss, we discovered that the hysteresis loss of a dust core can be sufficiently reduced by setting the area ratio of inclusions within the area of the matrix phase to be 0.4% or less, preferably 0.2% or less.

The lower limit is not restricted and may be 0%. When observing a cross-section of a certain powder, the area of the matrix phase of the powder refers to the result of subtracting the area of voids within the grain boundary of the powder from the area surrounded by the grain boundary of the powder.

In general, possible inclusions found in iron powder are oxides including one or more of Mg, Al, Si, Ca, Mn, Cr, Ti, Fe, and the like. In this disclosure, the area ratio of inclusions may be calculated with the following method.

First, the iron powder to be measured is mixed into thermoplastic resin powder to yield a mixed powder. The mixed powder is then injected into an appropriate mold and heated to melt the resin. The result is cooled and hardened to yield a resin solid that contains iron powder. An appropriate cross-section of this resin solid that contains iron powder is cut, and the resulting face is polished and treated by corrosion. Using a scanning electron microscope (1000× to 5000× magnification), the cross-sectional microstructure of the iron powder particles is then observed and imaged as a backscattered electron image. In the captured image, inclusions appear with dark contrast. Therefore, the area ratio of inclusions can be calculated by applying image processing to the image. We performed this process in five or more fields, calculated the area ratio of the inclusions in each observation field, and then used the average.

Another factor in iron loss is eddy current loss, which is loss that is greatly affected by insulation between particles. Therefore, if the insulation between particles is insufficient, eddy current loss increases greatly.

Upon examining insulation between particles, we discovered that if the oxygen content in the iron powder is less than 0.05 mass %, insulation between particles is not maintained after applying insulation coating, forming, and applying strain relief annealing. Instead, the eddy current loss ends up increasing.

The exact mechanism behind this phenomenon is unclear, yet since oxygen in iron powder exists as thin iron oxide covering the iron powder surface, the reason may be that if there is not a certain oxygen content in the iron powder, insulation between particles cannot be increased by a double insulation layer formed by iron oxide and the insulation coating. Therefore, the oxygen content needs to be 0.05 mass % or more. The oxygen content is preferably 0.08 mass % or more.

Conversely, if excessive oxygen is included in the iron powder, the iron oxide on the iron powder surface grows excessively thick. At the time of formation, the insulation coating may peel off, causing eddy current loss to increase. Furthermore, hysteresis loss may increase due to the generation of non-magnetic iron oxide particles in the iron powder particles. Therefore, the oxygen content is preferably set to a maximum of approximately 0.20 mass %. The oxygen content is more preferably less than 0.15 mass %.

Next, a representative method of manufacturing to obtain our product is described. Of course, a method other than the one described below may be used to obtain our product.

Our powders, which have iron as the principal component, are manufactured using an atomizing method. The reason is that powder obtained by an oxide reduction method or electrolytic deposition has a low apparent density, and even if the area ratio of inclusions and the oxygen content satisfy the conditions of this disclosure, the powder experiences large plastic deformation at the time of formation, the insulation coating breaks off, and eddy current loss ends up increasing greatly.

The atomizing method may be of any type, such as gas, water, gas and water, centrifugation, or the like. In practical terms, however, it is preferable to use an inexpensive water atomizing method or a gas atomizing method, which is more expensive than a water atomizing method yet which allows for relative mass production. As a representative example, the following describes a method of manufacturing when using a water atomizing method.

It suffices for the chemical composition of molten steel being atomized to have iron as the principal component. However, since a large quantity of oxide-based inclusions might be generated at the time of atomizing, the content of oxidizable metal elements (Al, Si, Mn, Cr, and the like) is preferably low. The following contents are preferable: Al≤0.01 mass %, Si≤0.07 mass %, Mn≤0.1 mass %, and Cr≤0.05 mass %. Of course, the content of oxidizable metal elements other than those listed above is also preferably reduced insofar as possible. The reason is that if oxidizable elements are added in excess of the above ranges, the inclusion area ratio increases and tends to exceed 0.4%, yet it is extremely difficult to set the inclusion area ratio to 0.4% or less in a subsequent process.

The atomized powder is then subjected to decarburization and reduction annealing. The reduction annealing is preferably high-load treatment performed in a reductive atmosphere that includes hydrogen. For example, one or multiple stages of heat treatment is preferably performed in a reductive atmosphere including hydrogen, at a temperature of 900° C. or more to less than 1200° C., preferably 1000° C. or more to less than 1100° C., with a holding time of 1 h to 7 h, preferably 2 h to 5 h, with the reductive atmosphere gas that includes hydrogen being applied in an amount of 3 L/min or more per 1 kg of iron powder, preferably 4 L/min or more. As a result, hydrogen penetrates to the inside of the powder and reduces inclusions inside the powder, thereby reducing the inclusion area ratio. Not only is the powder reduced, but also the grain size within the powder is effectively made more coarse. The dew point in the atmosphere is not limited and may be set in accordance with the C content included in the atomized powder.

If the oxygen after final reduction annealing is outside of the target range, additional heat treatment for adjusting the oxygen level can be performed.

When increasing the oxygen content in the powder because the oxygen level after final reduction annealing is below the target, it suffices to perform heat treatment in a hydrogen atmosphere that includes water vapor. At this time, the heat treatment conditions may be selected in accordance with the oxygen content after final reduction annealing, yet the heat treatment is preferably performed in the following ranges: a dew point of 0° C. to 60° C., heat treatment temperature of 400° C. to 1000° C., and soaking time of 0 min to 120 min. If the dew point is less than 0° C., deoxidation occurs and the oxygen amount ends up being further reduced, whereas if the dew point is higher than 60° C., even the inside of the powder ends up being oxidized. If the heat treatment temperature is lower than 400° C., oxidation is insufficient, whereas if the heat treatment temperature is higher than 1000° C., oxidation proceeds rapidly, making it difficult to control the oxygen content. Furthermore, if the soaking time is longer than 120 min, sintering of the powder progresses, making crushing difficult.

Conversely, when decreasing the oxygen content in the powder because the oxygen level after final reduction annealing is above the target, it suffices to perform heat treatment in a hydrogen atmosphere that does not include water vapor. At this time, the heat treatment conditions may be selected in accordance with the oxygen content after final reduction annealing, yet the heat treatment is preferably performed in the following ranges: heat treatment temperature of 400° C. to 1000° C., and soaking time of 0 min to 120 min. If the heat treatment temperature is lower than 400° C., reduction is insufficient, whereas if the heat treatment temperature is higher than 1000° C., reduction proceeds rapidly, making it difficult to control the oxygen content. Furthermore, if the soaking time is longer than 120 min, sintering of the powder progresses, making crushing difficult.

In the case of performing the below-described strain relief annealing, the target oxygen content may be achieved by adjusting the strain relief annealing conditions.

After the above-described decarburization and reduction annealing, grinding is performed with an impact grinder, such as a hammer mill or jaw crusher. Additional crushing and strain relief annealing may be performed on the ground powder as necessary.

Furthermore, an insulation coating is applied to the above-described iron powder to yield insulation-coated iron powder for dust cores.

The insulation coating applied to the powder may be any coating capable of maintaining insulation between particles. Examples of such an insulation coating include silicone resin; a vitreous insulating amorphous layer with metal phosphate or metal borate as a base; a metal oxide such as MgO, forsterite, talc, or $Al_2O_3$; or a crystalline insulating layer with $SiO_2$ as a base.

Setting the rate of addition (mass ratio) of the insulation coating with respect to the iron powder for dust cores to be at least 0.1 mass % or more is preferable for maintaining insulation between particles.

While there is no upper limit on the rate of addition, setting an upper limit of approximately 0.5 mass % is preferable in terms of manufacturing costs and the like.

Furthermore, in terms of heat resistance and ductility (the insulation coating needs to follow the plastic deformation of the powder at the time of formation), the insulation coating is preferably silicone resin.

After applying an insulation coating to the particle surface, the resulting insulation-coated iron powder for dust cores is injected in a die and pressure formed to a shape with desired dimensions (dust core shape) to yield a dust core. The pressure formation method may be any regular formation method, such as cold molding, die lubrication molding, or the like. The compacting pressure may be determined in accordance with use. If the compacting pressure is increased, however, the green density increases. Hence, a compacting pressure of 10 t/cm$^2$ (981 MPa) or more is preferable, with 15 t/cm$^2$ (1471 MPa) or more being more preferable.

At the time of the above-described pressure formation, as necessary, a lubricant may be applied to the die walls or added to the powder. At the time of pressure formation, the friction between the die and the powder can thus be reduced, thereby suppressing a reduction in the green density. Furthermore, the friction upon removal from the die can also be reduced, effectively preventing cracks in the green compact (dust core) at the time of removal. Preferable lubricants in this case include metallic soaps such as lithium stearate, zinc stearate, and calcium stearate, and waxes such as fatty acid amide.

The formed dust core is subjected, after pressure formation, to heat treatment in order to reduce hysteresis loss via strain relief and to increase the green compact strength. The heat treatment time of this heat treatment is preferably approximately 5 min to 120 min. Any of the following may be used without any problem as the heating atmosphere: the regular atmosphere, an inert atmosphere, a reductive atmosphere, or a vacuum. The atmospheric dew point may be determined appropriately in accordance with use. Furthermore, when raising or lowering the temperature during heat treatment, a stage at which the temperature is maintained constant may be provided.

EXAMPLES

Iron powder Nos. 1 to 7, which are atomized iron powders with different Si contents, were used. Table 1 lists the Si content of each iron powder. The composition other than Si was, for all of the iron powders, C<0.2 mass %, O<0.3 mass %, N<0.2 mass %, Mn<0.05 mass %, P<0.02 mass %, S<0.01 mass %, Ni<0.05 mass %, Cr<0.05 mass %, Al<0.01 mass %, and Cu<0.03 mass %. These powders were subjected to reduction annealing in hydrogen at 1050° C. for 2 h.

TABLE 1

| Iron powder No. | Si content (mass ppm) |
|---|---|
| 1 | 60 |
| 2 | 220 |
| 3 | 270 |
| 4 | 660 |
| 5 | 900 |
| 6 | 960 |
| 7 | 1370 |

For temperature elevation process and the first 10 min of soaking, the heat treatment was performed in a wet hydrogen atmosphere, subsequently switching to a dry hydrogen atmosphere. In the earlier wet hydrogen annealing, iron powder No. 1 was subjected to annealing at three different dew points: 40° C., 50° C., and 60° C., and at two hydrogen flow rates: 3 L/min/kg and 1 L/min/kg, whereas the other iron powders were all subjected to annealing in wet hydrogen at a dew point of 60° C. and at a hydrogen flow rate of 3 L/min/kg. The sintered body after annealing was ground with a hammer mill to yield ten types of pure iron powders. Table 2 lists the base iron powder No. and the reduction annealing conditions for the ten types of pure iron powders A to J.

TABLE 2

| Sample No. | Iron powder No. | Annealing conditions | Wet hydrogen dew point (° C.) | Hydrogen flow rate (L/min/kg) |
|---|---|---|---|---|
| A | 1 | 1050° C. × 2 h (temperature | 40 | 3 |
| B | 1 | elevation process and first | 50 | 3 |

TABLE 2-continued

| Sample No. | Iron powder No. | Annealing conditions | Wet hydrogen dew point (° C.) | Hydrogen flow rate (L/min/kg) |
|---|---|---|---|---|
| C | 1 | 10 min of soaking performed | 60 | 3 |
| D | 2 | with wet hydrogen, | | 3 |
| E | 3 | subsequently switching to | | 3 |
| F | 4 | dry hydrogen) | | 3 |
| G | 5 | | | 3 |
| H | 6 | | | 3 |
| I | 7 | | | 3 |
| J | 1 | | 60 | 1 |

The iron powders obtained with the above procedure were crushed at 1000 rpm for 30 min using a high-speed mixer (model LFS-GS-2J by Fukae Powtec) and then subjected to strain relief annealing in dry hydrogen at 850° C. for 60 min.

For these iron powders, Table 3 lists the oxygen content analysis value and the results of measuring the inclusion area ratio calculated by cross-section observation with a scanning electron microscope.

TABLE 3

| Sample No. | Oxygen content (mass %) | Inclusion area ratio (%) |
|---|---|---|
| A | 0.03 | 0.04 |
| B | 0.05 | 0.06 |
| C | 0.08 | 0.10 |
| D | 0.04 | 0.19 |
| E | 0.15 | 0.35 |
| F | 0.19 | 0.38 |
| G | 0.21 | 0.50 |
| H | 0.22 | 0.70 |
| I | 0.33 | 1.20 |
| J | 0.06 | 0.42 |

Furthermore, these iron powders were classified with sieves prescribed by JIS Z 8801-1 to obtain particle sizes of 45 μm to 250 μm. A portion of the classified iron powders was further classified with sieves having openings of 63 μm, 75 μm, 106 μm, 150 μm, and 180 μm. The particle size distribution was then calculated by measuring the powder weight, and the weight average particle size D50 was calculated form the resulting particle size distribution. The apparent density was measured with the test method prescribed by JIS Z 2504.

As a result, for all of the powders D50 was 95 μm to 120 μm, and the apparent density was ≥3.8 g/cm$^3$.

An insulation coating was then applied to these powders using silicone resin. The silicone resin was dissolved in toluene to produce a resin dilute solution such that the resin component is 0.9 mass %. Furthermore, the powder and the resin dilute solution were mixed so that the rate of addition of the resin with respect to the powder became 0.15 mass %. The result was then dried in the atmosphere. After drying, a resin baking process was performed in the atmosphere at 200° C. for 120 min to yield insulation-coated iron powder for dust cores (coated iron-based soft magnetic powders). These powders were then formed using die lubrication at a compacting pressure of 15 t/cm$^2$ (1471 MPa) to produce ring-shaped test pieces with an outer diameter of 38 mm, an inner diameter of 25 mm, and a height of 6 mm.

The test pieces thus produced were subjected to heat treatment in nitrogen at 650° C. for 45 min to yield samples. Winding was then performed (primary winding: 100 turns; secondary winding: 40 turns), and hysteresis loss measurement with a DC magnetizing device (1.0 T, DC magnetizing measurement device produced by METRON, Inc.) and iron loss measurement with an iron loss measurement device (1.0 T, 400 Hz and 1.0 T, 1 kHz, high-frequency iron loss measurement device produced by METRON, Inc.) were performed.

Table 4 lists the measurement results obtained by performing magnetic measurements on the samples.

In the Examples, the acceptance criterion for iron loss at 1.0 T and 400 Hz was set to 30 W/kg or less, an even lower value than the acceptance criterion for the Examples disclosed in PTL 1 and PTL 2 (50 W/kg or less). Furthermore, the acceptance criterion for iron loss at 1.0 T and 1 kHz was set to 90 W/kg or less, an even lower value than the minimum iron loss for the Examples disclosed in PTL 3 (117.6 W/kg or less).

TABLE 4

| Sample No. | Hysteresis loss (1.0 T, 400 Hz) (W/kg) | Eddy current loss (1.0 T, 400 Hz) (W/kg) | Iron loss (1.0 T, 400 Hz) (W/kg) | Hysteresis loss (1.0 T, 1 kHz) (W/kg) | Eddy current loss (1.0 T, 1 kHz) (W/kg) | Iron loss (1.0 T, 1 kHz) (W/kg) | Notes |
|---|---|---|---|---|---|---|---|
| A | 17.2 | 13.0 | 30.2 | 42.9 | 71.7 | 114.6 | Comparative Example |
| B | 17.9 | 7.3 | 25.2 | 44.8 | 45.0 | 89.8 | Example |
| C | 19.1 | 6.7 | 25.8 | 47.8 | 35.3 | 83.1 | Example |
| D | 21.3 | 11.2 | 32.5 | 53.3 | 62.6 | 115.9 | Comparative Example |
| E | 22.5 | 5.4 | 27.9 | 56.3 | 27.5 | 83.8 | Example |
| F | 22.5 | 4.9 | 27.4 | 56.1 | 23.9 | 80.1 | Example |
| G | 26.0 | 5.8 | 31.8 | 65.0 | 28.0 | 93.0 | Comparative Example |
| H | 28.0 | 6.6 | 34.6 | 70.0 | 32.0 | 102.0 | Comparative Example |
| I | 34.8 | 10.6 | 45.4 | 87.0 | 56.7 | 143.7 | Comparative Example |
| J | 25.1 | 7.0 | 32.1 | 62.0 | 42.0 | 104.0 | Comparative Example |

Table 4 shows that all of the Examples satisfied the above acceptance criterion for iron loss at 1.0 T and 400 Hz and at 1.0 T and 1 kHz.

Focusing on the hysteresis loss and eddy current loss, it is clear that the Comparative Examples with low oxygen content did not satisfy the acceptance criterion due to a large increase in eddy current loss as compared to the Examples, whereas the Comparative Examples with high oxygen content and a high inclusion area ratio did not satisfy the acceptance criterion due to an increase, as compared to the Examples, in either hysteresis loss or eddy current loss, or in both.

The invention claimed is:

1. Insulation-coated iron powder for dust cores comprising iron powder obtained by an atomizing method containing iron as a principal component and an insulation coating applied thereto, wherein a Si content in the iron powder is 660 ppm or less, a C content in the iron powder is 0.2 mass % or less, a N content in the iron powder is 0.2 mass % or less, a Mn content in the iron powder is 0.05 mass % or less, a P content in the iron powder is 0.02 mass % or less, a S content in the iron powder is 0.01 mass % or less, a Ni content in the iron powder is 0.05 mass % or less, a Cr content in the iron powder is 0.05 mass % or less, an Al content in the iron powder is 0.01 mass % or less, a Cu content in the iron powder is 0.03 mass % or less, an oxygen content in the iron powder is 0.05 mass % or more and less than 0.15 mass %, and in a cross-section of the iron powder, an area ratio of an inclusion to a matrix phase is 0.4% or less.

2. The insulation-coated iron powder for dust cores of claim 1, wherein a rate of addition of the insulation coating with respect to the iron powder for dust cores is 0.1 mass % or more.

3. The insulation-coated iron powder for dust cores of claim 1, wherein the insulation coating is silicone resin.

4. The insulation-coated iron powder for dust cores of claim 2, wherein the insulation coating is silicone resin.

* * * * *